United States Patent [19]

Jones

[11] 3,963,272

[45] June 15, 1976

[54] TABLE WITH ADJUSTABLE FOOT

[76] Inventor: Ferris E. Jones, 943 Millbury Ave., La Puente, Calif. 91746

[22] Filed: Sept. 23, 1974

[21] Appl. No.: 508,074

[52] U.S. Cl. ..... 297/172; 108/152; 248/188.6; 248/188.8; 297/174

[51] Int. Cl.[2] ..... A47B 39/00

[58] Field of Search ..... 297/140–144, 297/147, 157–159, 170, 172, 174; 108/134, 135, 152; 248/188.6, 188.8

[56] References Cited

UNITED STATES PATENTS

| | | | |
|---|---|---|---|
| 822,182 | 5/1906 | Cassel | 297/141 |
| 1,513,907 | 11/1924 | Hugo | 297/174 |
| 1,652,100 | 12/1927 | Eastburn | 297/141 |
| 3,379,144 | 4/1968 | Ellis | 108/135 X |
| 3,549,200 | 12/1970 | Cooper | 297/157 |

*Primary Examiner*—James C. Mitchell
*Attorney, Agent, or Firm*—Boniard I. Brown

[57] ABSTRACT

A table having a supporting base with a lateral mounting extension for attachment cantilever fashion to a supporting structure with the bottom of the base spaced above the floor, and a supporting foot mounted at the bottom of the base below the table top for movement between a lower extended position werein the foot projects below the base for supporting contact with the floor and an upper retracted position wherein the foot is raised above the floor to facilitate cleaning the floor below the base.

A furniture combination including the table and a bench seat to which the table base is secured to form the supporting structure for the table. In its extended position, the supporting foot for the table base may incline slightly from the vertical in a direction away from the bench seat to resist movement of the seat in the latter direction.

25 Claims, 10 Drawing Figures

FIG. 1.
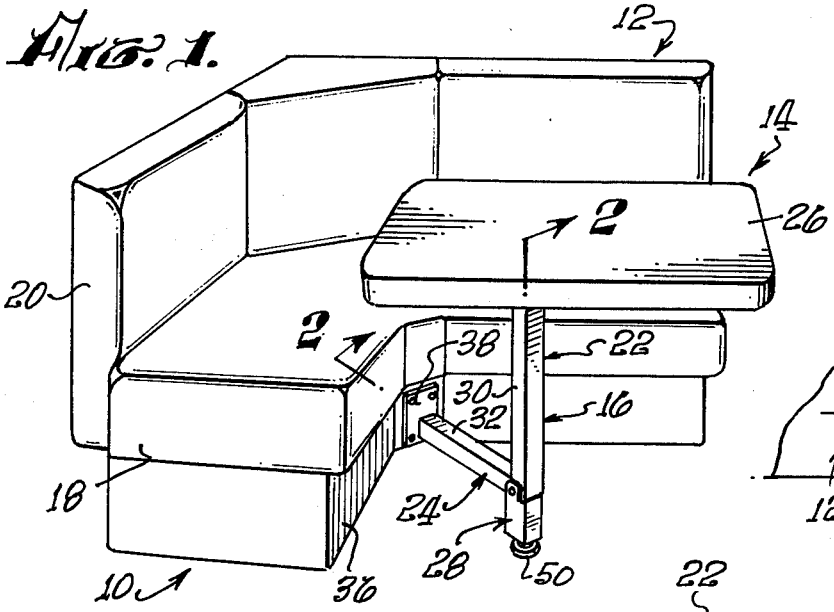
FIG. 5.
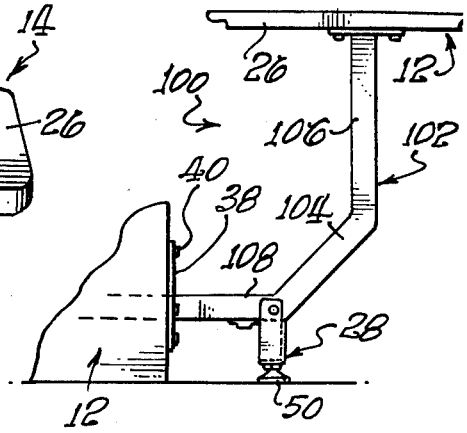
FIG. 3.
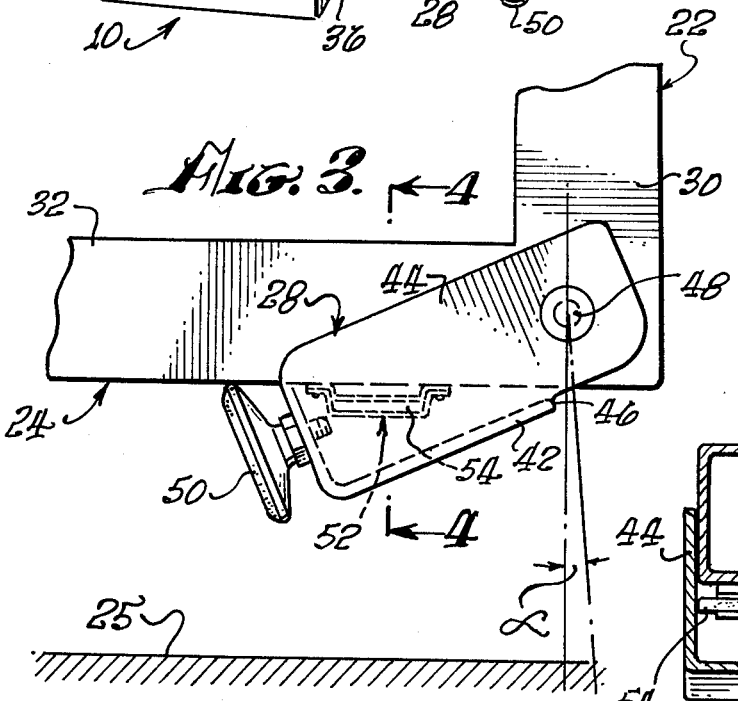
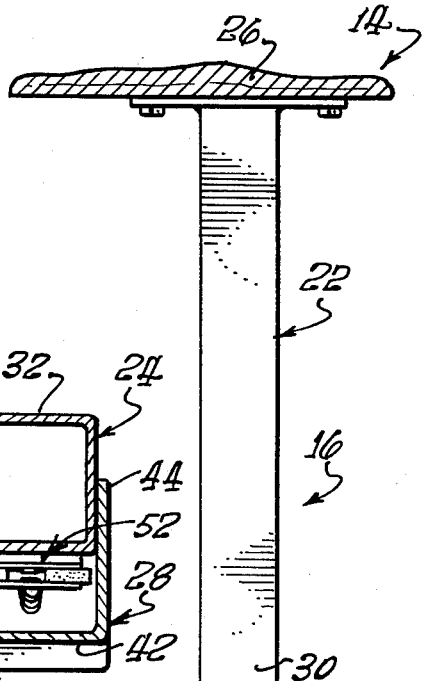
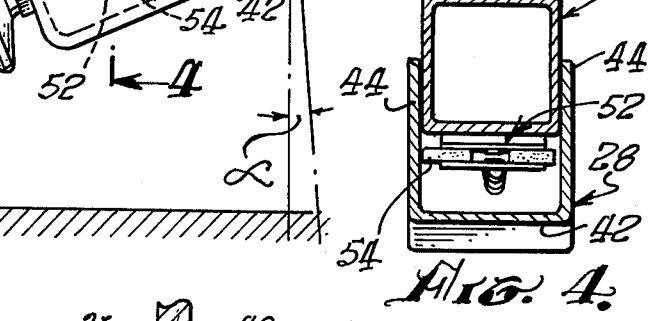
FIG. 4.
FIG. 2.
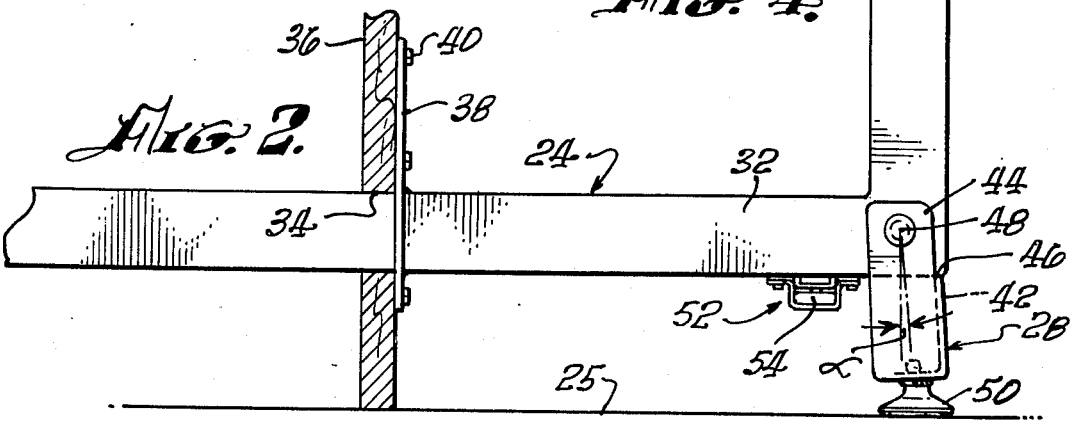

TABLE WITH ADJUSTABLE FOOT

BACKGROUND OF THE INVENTION

1. Field of the Invention

This invention relates generally to the furniture art and more particularly to a novel table construction and a furniture combination including the table and a bench seat which are uniquely constructed and arranged to facilitate cleaning the floor below the table.

2. Prior Art

One common form of dining facility for both private dwellings and public dining establishments consists of a bench seat and table. In many such dining facilities, the table base rests on or is fastened to the floor and thus interferes with cleaning the floor below the table. A variety of bench seat and table arrangements have been devised to alleviate this floor cleaning problem. In one such arrangement for example, the table base is hinged to the bench seat in such a way that the table may be elevated to a raised position wherein the base is spaced above the floor to facilitate cleaning the floor. When the table is lowered to its normal position of use, the base rests on the floor to provide a firm support for the table. My co-pending application Ser. No. 371,168, entitled BENCH SEAT. Now U.S. Pat. No. 3,885,830 describes a bench seat and table combination of this kind.

Another type of bench seat and table combination which alleviates the above-mentioned floor cleaning problem utilizes a table base which is attached cantilever fashion to the bench seat with the bottom of the base spaced above the floor to permit cleaning the floor below the table. This type of bench seat and table combination presents the advantage over the hinged table configuration of greater simplicity, reduced cost, and elimination of the necessity of raising and lowering the table. The cantilevered table arrangement, however, has one disadvantage with which this invention is concerned. This disadvantage resides in the fact that the cantilevered table base is not supported on the floor below the table top and hence must be made quite rugged to withstand the loads exerted on the table in use. Even with such a rugged base construction, however, the cantilevered tables are sometimes damaged due to excessive forces or loads on the table.

The present invention provides an improved bench seat and cantilevered table combination which avoids this disadvantage of the existing cantilevered table arrangements. As will become evident from the ensuing description, however, the cantilevered table construction of the invention, while intended primarily for use with a bench seat to provide a dining facility, may be used by itself as a general purpose table which may be attached to a supporting structure other than a bench seat, such as a wall.

SUMMARY OF THE INVENTION

According to one of its aspects, this invention provides a table having a normally upright supporting base with a lateral mounting extension for attachment cantilever fashion to a supporting structure with the bottom of the base spaced above the floor to provide a clearance space between the base and floor. A supporting foot is mounted on the bottom of the base below the table top for movement between a lower extended position and an upper retracted position. In its lower extended position, the foot projects below the base for supporting contact with the floor to provide a firm base for the table. In its upper retracted position, the foot is raised above the floor to permit cleaning the floor below the base. Holding means are provided for releasibly holding the foot in its retracted position, and stop means are provided for limiting movement of the foot in the direction of its extended position.

Conceivably, the table may be used by itself as a general purpose table by attaching the lateral mounting extension of the table base to a wall or the like. According to a further aspect of the invention, however, the table is combined with a bench seat to provide a dining facility for use in homes, restaurants, and the like. In this use, the lateral mounting extension of the base is attached to the seat frame or base in such a way the base projects forwardly in cantilever fashion from the seat to support the table top in a position of use in front of the seat. The bottom of the base is spaced from the floor and the foot is extendable to support the table on the floor and retractable to permit cleaning below the table, as mentioned. According to a feature of this bench seat-table combination, or furniture combination as it is referred to herein, the supporting foot in its extended position may incline slightly from the vertical in a direction away from the bench seat to resist movement of the seat in the latter direction. This feature may be utilized, for example, to hold the seat against a wall or the like, against which the seat backs.

BRIEF DESCRIPTION OF THE DRAWINGS

FIG. 1 illustrates a furniture combination according to the invention, including a bench seat and cantilevered table, in its configuration of use;

FIG. 2 is an enlarged section taken on line 2—2 in FIG. 1;

FIG. 3 is a fragmentary view of the lower right-hand portion of FIG. 2 showing the supporting foot of the table in its raised cleaning position;

FIG. 4 is a section taken on line 4—4 in FIG. 3;

FIG. 5 is a fragmentary view of a furniture combination embodying a modified cantilevered table;

DESCRIPTION OF THE PREFERRED EMBODIMENT

Figure 6:
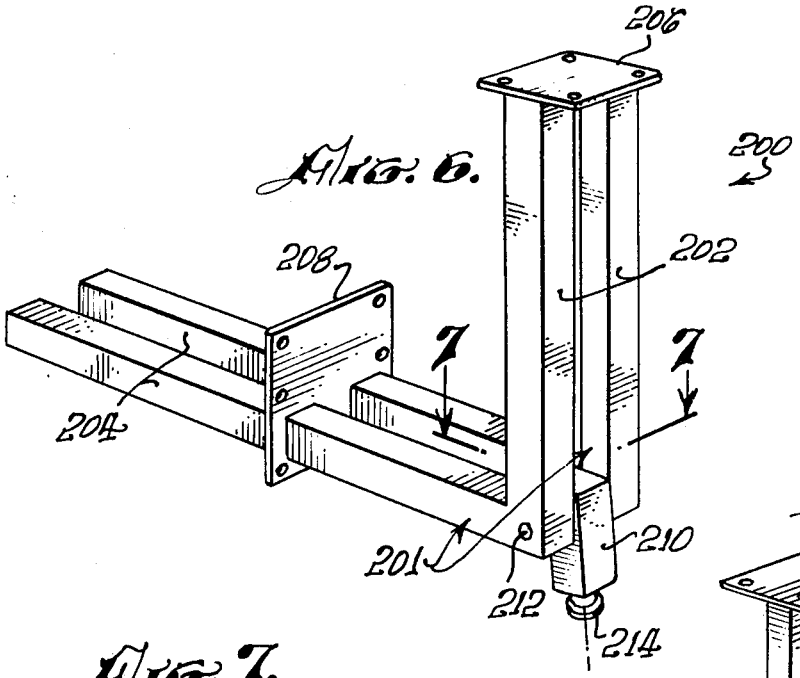
FIG. 6 is a perspective view of a modified table supporting base according to the invention.

Referring first to FIGS. 1–4, the furniture combination 10 illustrated, comprises a bench seat 12 and a table 14 positioned in front of the seat. Seat 12, which is shown to be a corner seat, has a frame or base 16 supporting seat and backrest cushions 18, 20. The seat is conventional and hence need not be explained in any more detail.

Table 14 includes an upright supporting base 22 having a lateral mounting extension 24 attached in cantilever fashion to the base of the bench seat 12 with the bottom of the base spaced above the floor 25 to provide a clearance space between the base and floor. Mounted atop the base is a table top 26. At the bottom of the base, below the top 26, is a supporting foot 28. This foot is mounted in the base for movement between its lower extended position of FIGS. 1 and 2 and its upper retracted position of FIG. 3.

In its lower extended position, the foot 28 projects below the table base 22 for supporting contact with the floor 25 to provide a firm support for the table. In its upper retracted position, the foot is raised above the floor to permit cleaning the floor below the table.

In the particular table construction illustrated, the table base 22 comprises an upright column 30 mounting the table top 26 and an arm 32 extending laterally from the lower end of the column toward and through the base 16 of the bench seat 12. In the case of the corner seat illustrated, the arm 32 extends diagonally through the corner portion of the seat, as shown. As shown best in FIG. 2, the arm passes through an opening 34 in the front wall 36 of the seat base and then through the hollow interior of the seat base to its rear wall (not shown). Welded or otherwise rigidly fixed to the arm is a mounting plate 38, which is attached by fasteners 40 to the base wall 36. The rear end of the arm is secured by means (not shown) to the rear wall of the seat base.

Arm 32 and mounting plate 38 together constitute the lateral mounting extension 24 of the table base 22. This arm extends forwardly and horizontally from the seat base 16 in cantilever fashion, a distance above the floor 25 to provide a clearance space between the arm and floor as mentioned above and shown. The table base column 30 rises vertically from the outer or forward end of the arm.

Supporting foot 28 comprises a channel-like member having a generally L-shaped web portion 42 and flanges 44 along the longitudinal edges of the web portion. These flanges extend beyond the normally upper edge 46 of the web portion to form ears which straddle the table base 22 at the juncture of the base column 30 and mounting arm 32 and are pivotally attached to the base by a pivot 48. The foot is thus swingable between the extended table supporting position of FIGS. 1 and 2 and its retracted or raised floor cleaning position of FIG. 3 on a pivot axis normal to a plane contouring the column and arm.

Swinging of the foot 28 in the direction of its extended position is limited by engagement of the foot web edge 46 with the underside of the table base 22, as shown in FIG. 2. The edge 46 and base thus provide limit stop means for the foot. The foot has a lower floor engaging pad 50 which rests on the floor in the extended position of the foot. According to a feature of the invention, the stop shoulder 46 in the foot may be located to limit extension of the foot to a position wherein the foot is inclined at a small angle $\alpha$ from the vertical in a direction opposite the direction of extension of the base arm, i.e. away from the seat 12, to resist movement of the seat in the latter or forward direction. This inclined attitude of the foot, for example, is useful in holding the seat against a wall at the back of the seat. It will now be understood that when the supporting foot 28 occupies its extended position, it supports the table base 22 on the floor 25, at the outer end of the cantilevered base mounting arm 30 and below the table top 26 to provide a firm support for the table.

Supporting foot 28 is swingable from its extended position to a retracted or raised position under the base mounting arm 32 as shown in FIG. 3. Holding means 52, in this instance a magnetic catch with a floating magnet 54, is mounted on the underside of the base arm 32 to hold the foot in its raised position. In this position, the foot is spaced above the floor 25 to facilitate cleaning the floor below the table.

The modified furniture combination 100 of FIG. 5 is identical to that of FIGS. 1–4 except that the table base column 102 has a lower oblique portion 104 and an upper vertical portion 106. The oblique column portion 104 slopes away from the bench seat 12. This table base configuration permits the cantilevered base mounting arm 108 to be shortened for any given spacing between the seat 12 and the table top 26.

Figure 7:
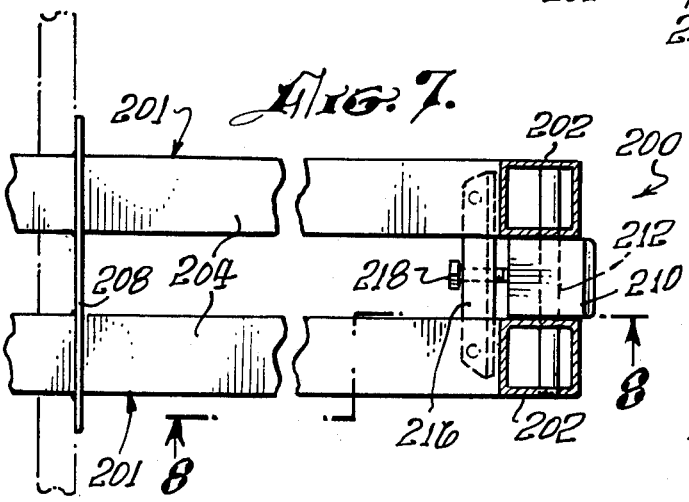
FIG. 7 is a section taken on line 7—7 in FIG. 6.
Figure 8:
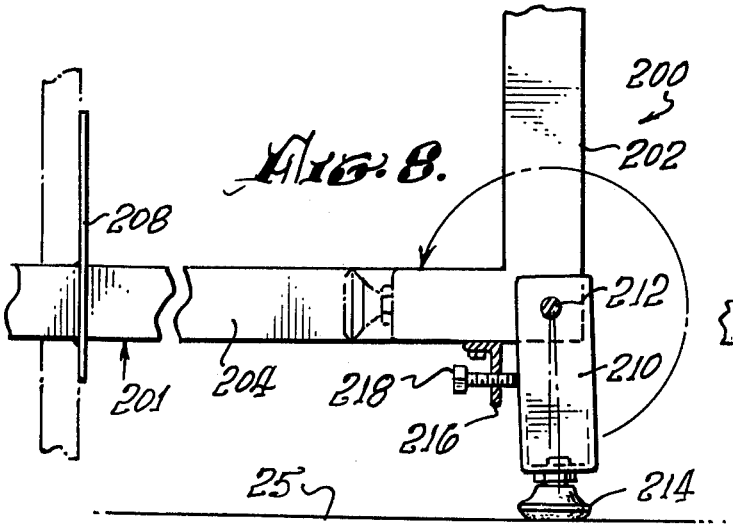
FIG. 8 is a section taken on line 8—8 in FIG. 7.

The modified table base 200 of FIGS. 6–8 comprises a pair of base members 201 each identical to the base 22 of the table in FIGS. 1–4 and including a vertical column 202 and a transverse base mounting arm 204 extending laterally from the bottom of the column. The two base members 201 are disposed side by side with an intervening spacing and are rigidly joined by a table top mounting plate 206 secured to the upper ends of the base columns 202 and by a base mounting plate 208 through which the mounting arms extend and to which the arms are secured Positioned between the base members 201, at the juncture of their columns 202 and arms 204 is a supporting foot 210. This foot is hingably attached by a pivot 212 to the base members to swing between its solid line extended position and its broken line retracted position of FIG. 8. Secured to the lower end of the foot is a floor engaging pad 214.

Extending between and secured to the undersides of the base arms 204 adjacent the foot 210 is a support member 216. This support member carries a stop screw 218 which engages the foot in its extended position to limit swinging of the foot toward the latter position. This screw is preferably adjusted to locate the foot, when extended, in a position slightly inclined from the vertical in a direction opposite the direction of extension of the base arms 204, as shown best in FIG. 8, for the reasons explained in connection with the table of FIGS. 1–4. In its extended position, then, the foot 210 rests on the floor 25 to provide a firm support for the table. The foot is swingable from its extended position up and over the support member 216 to its retracted position, wherein the foot rests in the member, which thus provides a means for holding the foot in its retracted position. In this retracted position, the foot is raised above the floor to facilitate cleaning the floor below the table.

Figure 9:
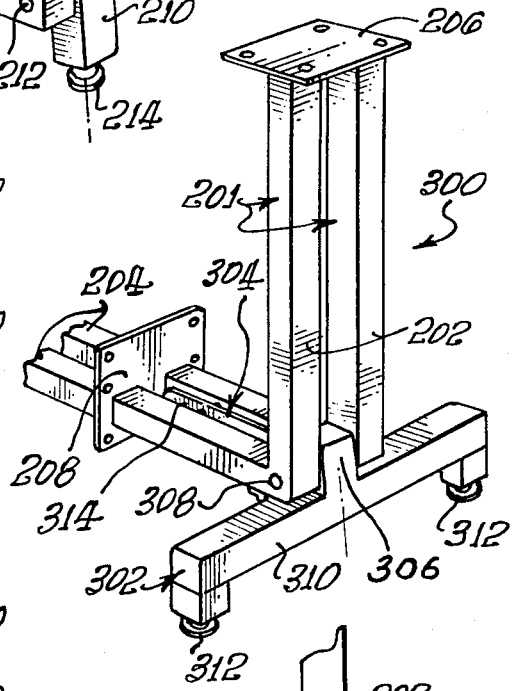
FIG. 9 is a perspective view of a further modified table supporting base according to the invention.
Figure 10:
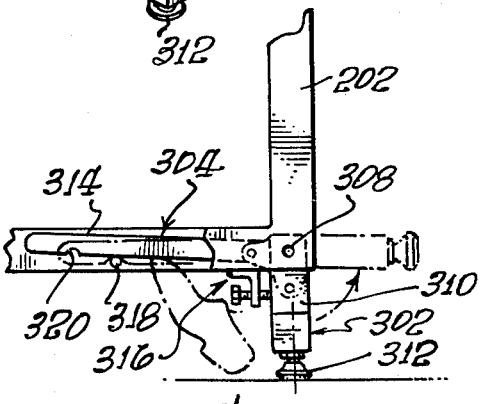
FIG. 10 is a side elevation, partly broken away, of the table base in FIG. 9.

The modified table base 300 of FIGS. 9 and 10 is identical to that of FIGS. 6–8 except for the shape of its supporting foot 302 and the holding means 304 for retaining the foot in its broken line retracted position of FIG. 10. Thus, the table base 300 comprises a pair of base members 201 like those of the table base in FIGS. 6–8 joined by a table top mounting plate 206 and a base mounting plate 208. The supporting foot 302 of the table base 300 has a tongue 306 hingedly mounted by a pivot 308 between the base members 201 and a cross bar 310 joined at its center to the tongue and paralleling the axis of the pivot 308. Attached to the underside of the crossbar at its ends are floor engaging pads 312. Foot 302 is swingable between its full line extended position and broken line retracted position of FIG. 10.

The holding means 304 for retaining the foot 302 in its broken line retracted position of FIG. 10 comprises latch means including a latch bar 314 attached at one end to the upper end of the foot tongue 306 by a pivot 316 parallel to and spaced from the foot pivot 308, laterally of the longitudinal axis of the tongue. Latch bar 314 extends from the tongue through the space between the base arms 204 and over a pin detent 318 which is fixed to the arms. When the foot 302 is retracted, this detent enters a recess 320 in the lower edge of the latch bar to latch the foot in its retracted position. The lower edge of the latch bar is then disposed to be engaged by the foot, as shown in broken lines in FIG. 10, for elevating the bar clear of the pin and thereby releasing the foot for return to its extended position. In this position, the foot rests on the floor to provide a firm support for the table.

The inventor claims:

1. A table comprising:

a normally upright supporting base including a lateral mounting extension rigidly joined at one end to the base and extending laterally from the base at a permanently fixed angle relative to the base, means at the other end of said extension for rigidly attaching said extension to a supporting structure in a permanently fixed generally horizontal position for supporting of said table in cantilever fashion by said structure with the bottom of said base spaced above the floor, a table top mounted atop said base, a supporting foot at the bottom of said base directly below said top, and means mounting said foot on said base for movement relative to said base between a lower extended position wherein said foot projects below said base for supporting contact with the floor and an upper retracted position wherein said foot is raised to clear the floor to facilitate cleaning the floor below said base.

2. A table according to claim 1 wherein:

said foot is pivotally mounted on said base to swing between said extended and retracted positions.

3. A table according to claim 1 including:

means for releasibly holding said foot in said retracted position.

4. A table according to claim 3 wherein:

said holding means comprises magnetic means.

5. A table according to claim 3 wherein:

said holding means comprises detent means.

6. A table according to claim 3 wherein:

said holding means comprises a support member on said base on which said foot rests in said retracted position.

7. A table according to claim 1 wherein:

said foot is pivotally mounted on said base to swing between said extended and retracted positions, and said foot in its extended position is inclined slightly from the vertical in a direction opposite the direction of extension of said base mounting extension.

8. A table according to claim 1 wherein:

said base includes a normally upright supporting column mounting said top and a transverse mounting arm extending laterally from the lower end of said column and comprising said base mounting extension, said foot is mounted on said base adjacent the lower end of said column, and means for releasibly holding said foot in its retracted position.

9. A table according to claim 8 wherein:

said foot is pivotally mounted adjacent the lower end of said column to swing between said extended and retracted positions about a pivot axis normal to a plane containing column and arm.

10. A table according to claim 9 wherein:

said foot, when extended, is positioned upright below said base.

11. A table according to claim 10 wherein:

said foot is swingable from said extended position toward the underside of said arm to said retracted position, and said holding means comprises coacting magnetic means in said arm and foot.

12. A table according to claim 11 wherein:

said foot in its extended position is inclined slightly from the vertical in a direction opposite the direction of extension of said arm.

13. A table according to claim 12 including:

stop means for limiting swinging of said foot in the direction of its extended position.

14. A table according to claim 8 wherein:

said column has a lower portion which is inclined from the vertical in a direction opposite the direction of extension of said arm and a normally vertical upper portion.

15. A table according to claim 8 wherein:

said holding means comprises a laterally projecting support member in said arm adjacent said column, said foot is pivotally mounted adjacent the lower end of said column to swing between said extended and retracted positions about a pivot axis normal to a plane containing said column and arm, said foot when extended is positioned upright below said base, and said foot is swingable from said extended position up and over said support member to a retracted position wherein the foot rests on said support member.

16. A table according to claim 15 wherein:

said foot in its extended position is inclined slightly from the vertical in a direction opposite the direction of extension of said arm.

17. A table according to claim 15 including:

stop means for limiting swinging of said foot in the direction of its extended position.

18. A table according to claim 17 wherein:

said stop means is adjustable.

19. A table according to claim 8 wherein:

said foot is pivotally mounted adjacent the lower end of said column to swing between said extended and retracted positions about a pivot axis normal to a plane containing column and arm, and said holding means comprises latch means.

20. A table according to claim 19 wherein:

said latch means comprises a latch bar pivotally attached to said foot on a pivot axis spaced from the pivot axis of the foot and having a recess entering an edge of the latter arm, and a detent on said extension arm engagable in said recess.

21. A furniture combination comprising:

a bench seat, and a table positioned in front of said seat including an upright supporting base, a mounting extension rigidly joined at one end to the base and extending laterally from the base at a permanently fixed angle relative to the base, means at the other end of said extension rigidly securing said extension to said bench seat with said extension extending forwardly of said seat at a permanently fixed angle relative to said seat such that the bottom of said base is spaced above the floor, a table top mounted atop said base, and a foot mounted on the bottom of said base directly below said top for movement relative to said base between a lower extended position wherein said foot projects below said base for supporting contact with the floor and an upper retracted position wherein said foot is raised to clear the floor to facilitate cleaning the floor below the base.

22. The furniture combination according to claim 21 wherein:

said foot in its extended position is inclined slightly from the vertical in a direction away from said seat.

23. The furniture combination according to claim 21 including:

means for releasibly holding said foot in its retracted position.

24. The furniture combination according to claim 21 wherein:

said base includes a normally upright column mounting said top and a transverse arm extending laterally from the lower end of said column to said seat and comprising said mounting extension, said foot is pivotally mounted adjacent the lower end of said column to swing between said extended and retracted positions about an axis normal to a plane containing said column and arm, means for releasibly holding said foot in its retracted position.

25. The furniture combination according to claim 24 wherein:

said foot in its extended position is inclined slightly from the vertical in a direction away from said seat, and stop means for limiting swinging of said foot in the direction of its extended position.

* * * * *